US005232215A

United States Patent [19]

Hashimoto et al.

[11] Patent Number: 5,232,215

[45] Date of Patent: Aug. 3, 1993

[54] SHEET FEED CASSETTE FOR IMAGE FORMING APPARATUS

[75] Inventors: Yusaku Hashimoto; Hidekazu Amamoto; Naomasa Okimura; Koichi Okabe, all of Saitama, Japan

[73] Assignee: Fuji Xerox Co., Ltd., Tokyo, Japan

[21] Appl. No.: 873,758

[22] Filed: Apr. 27, 1992

[30] Foreign Application Priority Data

Apr. 30, 1991 [JP] Japan ..... 3-126811

[51] Int. Cl.[5] ..... B65H 1/10

[52] U.S. Cl. ..... 271/160; 271/22; 271/126

[58] Field of Search ..... 271/22, 24, 30.1, 126, 271/128, 147, 160

[56] References Cited

U.S. PATENT DOCUMENTS 3,919,972 11/1975 Komori et al. ..... 271/160 X

FOREIGN PATENT DOCUMENTS 0037500 3/1977 Japan ..... 271/160
566832 6/1979 Japan .
5664938 10/1979 Japan .
57-157954 2/1982 Japan .
0022826 2/1984 Japan ..... 271/160
0114932 6/1986 Japan ..... 271/24
2176465 12/1986 Japan ..... 271/24
0139840 6/1988 Japan ..... 271/160
2202517 3/1988 United Kingdom .

*Primary Examiner*—H. Grant Skaggs
*Assistant Examiner*—Carol Lynn Druzbick
*Attorney, Agent, or Firm*—Finnegan, Henderson, Farabow, Garrett & Dunner

[57] ABSTRACT

A sheet feed cassette to be installed to a sheet feed unit of an image forming apparatus. The sheet feed cassette includes a frame unit having at least a side frame and a bottom frame; a bottom plate, provided above the bottom frame of the frame unit, for placing and supporting sheets thereon, the bottom plate being capable of moving up and down; a pushing-up unit, provided at a front end portion of a sheet feed side of the bottom plate, for pushing up the bottom plate with respect to the bottom frame of the frame unit when the sheet feed cassette is installed to the sheet feed unit of the image forming apparatus; and a spring, provided at an end portion opposite to the sheet feed side of the bottom plate, for urging up the bottom plate with respect to the bottom frame of the frame unit.

7 Claims, 5 Drawing Sheets

SHEET FEED CASSETTE FOR IMAGE FORMING APPARATUS

BACKGROUND OF THE INVENTION

1. Field of the Invention

The invention relates to a sheet feed cassette that is installed to a sheet feeder of an image forming apparatus such as a laser printer and used to feed and forward sheets toward the image transfer section one by one. More particularly, the invention is directed to a sheet feed cassette capable of holding the front end of a sheet to a predetermined position by moving the bottom plate up and down while maintaining horizontal state thereof.

2. Description of the Related Art

In an image forming apparatus such as a laser printer or an electronic copying machine, cut sheets are contained in a sheet container unit such as a sheet feed cassette or a sheet feed tray, such sheet container unit is installed to a sheet feeder of the image forming apparatus, and the sheets are fed one by one using a sheet feed member such as a sheet feed roller disposed on the sheet feed unit. The image forming apparatus using such a sheet container unit is, e.g., a laser printer shown in FIG. 8. The laser printer 20 shown in FIG. 8 employs a sheet feed cassette la as a sheet container unit. A sheet feed roller 50 is disposed on the sheet feeder to which the sheet feed cassette la is installed, and a sheet fed by the sheet feed roller 50 is forwarded by a forward roller unit 52 along a sheet forward path 51.

In the upstream side of an image transfer section from a photoreceptor drum 41, a registration member 58 is disposed. Using this registration member 58, the sheet is temporarily stopped and then forwarded at such a timing as to allow its front end to be aligned with a toner image formed on the photoreceptor drum 41. Then, the toner image is transferred onto the sheet by discharging operation of a transfer corotron 24, a copy is prepared by fusing the sheet carrying the toner image through a fuser unit 25, and the copy is discharged through a discharge roller 26 or 26*a*. Like ordinary electrophotographic printers, the above-mentioned laser printer 20 includes a charge corotron 45, a developing roller 43 of a developing unit, and a blade 46 of a cleaning unit with respect to the photoreceptor drum 41. Further, using a laser beam applied from an image writing unit 31, an image is written to form a latent electrostatic image on the photoreceptor drum 41, and toner is supplied from the developing unit to the latent electrostatic image to fuse and form the toner image.

Further, in the laser printer 20 shown in FIG. 8, the sheet feed cassette to be installed to the sheet feeder is provided with a means for elevating a bottom plate that supports sheets, and a means for biasing the front end portion of the plate against the sheet feed roller at a predetermined pressure while supporting the rear end portion of the plate which is the sheet feed side through a pivot. Such means for holding the sheets at an elevated position includes, as disclosed in Japanese Utility Model Unexamined Publication No. Sho. 56-6832, one that elevates the sheet supporting bottom plate so as to be inclined by a pushing-up arm, or one that elevates the bottom plate by a spring.

However, as described above, in the case of the sheet feed cassette in which the rear portion of the sheet supporting bottom plate is supported through the pivot to elevate the front end side of the plate so as to be inclined, the angle of inclination of the sheet varies depending on the amount of sheets remaining on the plate, which is a problem. When the angle of inclination of the bottom plate becomes varied, the position of the front end on the feed side of the sheet becomes inconsistent and the position at which the front end of the sheet abuts against the sheet feed roller varies, thereby imposing the additional problem that the timing of feeding each sheet cannot be maintained constant. That is, as shown in FIG. 6, the relationship between the amount of sheets contained in the sheet feed cassette and the position of the front end of each sheet at the registration position on the sheet forward path is such that the greater the amount of sheets contained in the sheet feed cassette, the more the position of the front end of the sheet at the registration unit varies. For example, in the case of a sheet feed cassette that can contain 250 sheets, a variation of 4 mm or more is observed between a case in which such cassette contains a large amount of sheets therein and a case in which it contains few sheets. To overcome this problem, the conventional image forming apparatus has to arrange a member for positioning the front end of a sheet such as a registration roller along the sheet forward path so that the sheet can be forwarded toward the image transfer section using this registration roller at a timing corresponding to a toner image formed on the photoreceptor drum.

To overcome the above problem, as proposed, e.g., in Japanese Utility Model Unexamined Publication No. Sho. 57-57954, a means for supporting the bottom plate by two springs to thereby maintain the front end on the sheet feed side horizontally. However, if the means for biasing the bottom plate upward all the time by the springs as in the conventional example is employed, the operation of inserting the front ends of the sheets into the lower portion of a snubber becomes cumbersome when replenishing sheets in the sheet feed cassette. Also, when the sheet feed cassette is extracted from the sheet feed unit, the sheets contained in the sheet feed cassette must be lowered using some kind of means. In this case, if the lowering means resisting the spring force is provided on the sheet feed unit of the image forming apparatus body, the mechanism of the sheet feed unit of the apparatus is complicated, which is a disadvantage.

In contradistinction thereto, e.g., Japanese Utility Model Unexamined Publication No. Sho. 56-64938 proposes a means for moving the bottom plate of a sheet feed tray vertically using a link mechanism. In the sheet feed tray referred to in this conventional example includes a means for driving the bottom plate using a cam mechanism, the bottom plate being supported by the link mechanism. The bottom plate is moved up and down while maintaining the horizontal state thereof, so that it can prevent the above-mentioned timing at which sheets are fed from being inconsistent. However, when using the above-mentioned drive mechanism with the link, the mechanism for supporting the plate inside the sheet feed tray becomes complicated, and a drive mechanism for the link is also complicated because the drive mechanism must be provided in the sheet feed unit. As a result, this type of sheet feed tray is not suitable for use in a small-sized image forming apparatus from the viewpoint of installation space, manufacturing cost, and other various factors.

SUMMARY OF THE INVENTION

The invention has been made to overcome the above-mentioned problems of the sheet feeder of the image forming apparatus. An object of the invention is therefore to provide a sheet feed cassette capable not only of simplifying the mechanism for supporting the bottom plate that is disposed inside the sheet feed cassette but also of supporting sheets substantially horizontally and maintaining a consistent sheet feed timing independently of the amount of sheets contained in the cassette. Another object of the invention is to provide a sheet feeder capable of transferring a toner image onto a sheet satisfactorily without providing a sheet registration adjustment mechanism along the sheet forward path of the image forming apparatus.

To accomplish the above objects, the present invention provides a sheet feed cassette to be installed to a sheet feed unit of an image forming apparatus, comprising frame means including at least a side frame and a bottom frame; a bottom plate, provided above the bottom frame of the frame means, for placing and supporting sheets thereon, the bottom plate being capable of moving up and down; pushing-up means, provided at a front end portion of a sheet feed side of the bottom plate, for pushing up the bottom plate with respect to the bottom frame of the frame means when the sheet feed cassette is installed to the sheet feed unit of the image forming apparatus; and first spring means, provided at an end portion opposite to the sheet feed side of the bottom plate, for urging up the bottom plate with respect to the bottom frame of the frame means.

DETAILED DESCRIPTION OF THE PREFERRED EMBODIMENT

Figure 1:
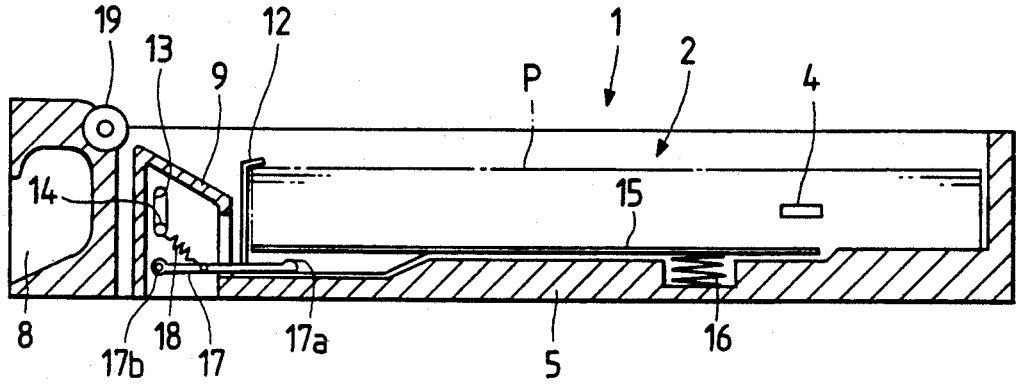
FIG. 1 is a side view of a sheet feed cassette of the invention.

A sheet feed cassette for an image forming apparatus of the invention will be described with reference to the drawings. In a sheet feed cassette 1 of the invention shown in FIGS. 1 and 2, a side frame 3 and a front side guide 9 are arranged around a sheet container section 2, and below the sheet container section 2 is a bottom frame 5. On the bottom frame 5, guide rail members 6 and 7 are arranged so as to intersect each other orthogonally, with guide members being arranged so as to be movable and fixable along the rail members. On the guide rail member 6 of the bottom frame 5, arranged is an end guide 10 that extends in a sheet feed direction. The end guide 10 regulates the tail end of a sheet. With respect to the rail member 7 disposed in the direction orthogonal to the rail member 6, side guides 11 and 11*a* for regulating the side ends of the sheet are arranged so as to allow each side guide member to be held at an arbitrary position.

On the front end portion that is the sheet feed side of the sheet feed cassette 1 provided is a handle 8, and on the sheet container section 2 side of the handle 8 provided is a front guide 9 having an inclined guide surface. Rollers 19 are also disposed so as to correspond to the front end portion of the inclined surface of the front guide 9. As will be described later, the rollers 19 are those acting as pinch rollers for the forward roller unit when the sheet feed cassette is installed to the image forming apparatus, and they are integrated with the sheet feed cassette in this embodiment. The sheet feed cassette of the invention does not particularly have to be integrated with the roller members. As in the case of ordinary sheet feed cassettes, the sheet feed cassette of the invention is applicable to an image forming apparatus in which the forward roller unit is disposed on the image forming apparatus body.

Figure 2:
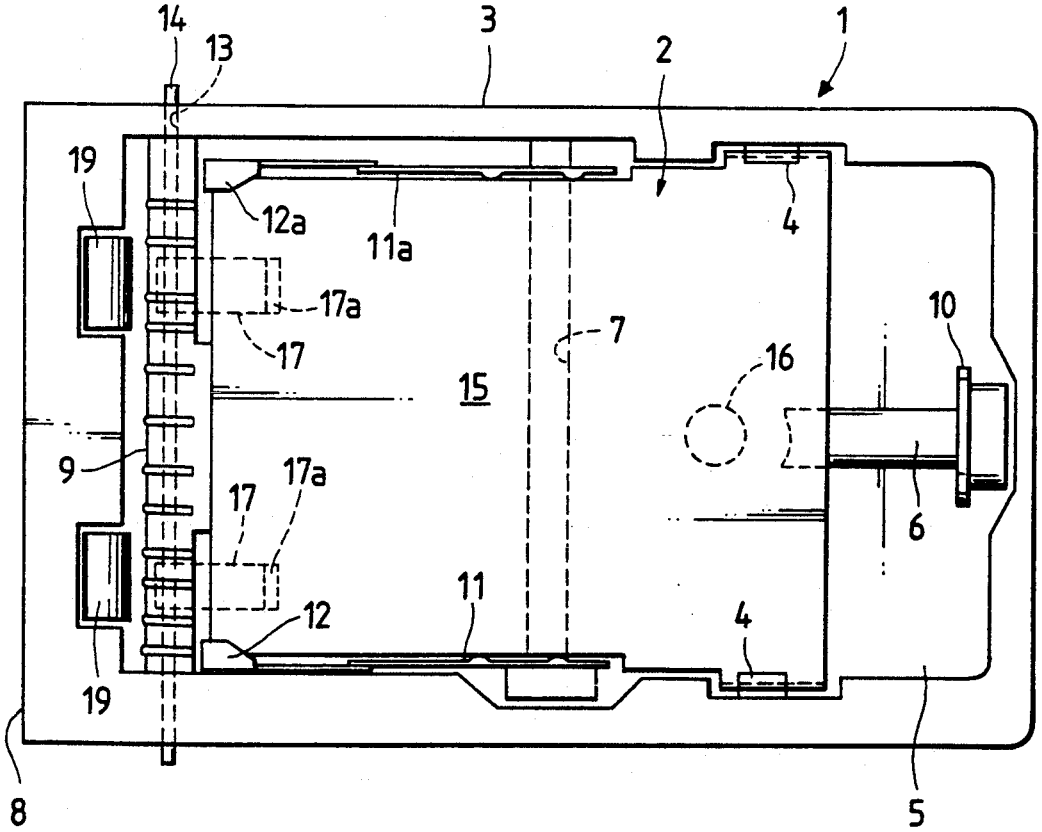
FIG. 2 is a plan view of the sheet feed cassette of the invention.

The sheet container section 2 of the sheet feed cassette 1 is provided with a bottom plate 15 on which a sheet P is placed. The bottom plate 15 is not designed to support only the front end portion of the sheet which is the feed side as in the case of the conventional bottom plate, but is arranged to such a size as to allow sheets of a size slightly smaller than those of a large size to be contained. On the end portion of the end guide side of the bottom plate 15, a spring 16 is arranged, while on the front side portion in the sheet feed direction, pushing-up arms 17 are arranged as shown in FIG. 1, so that the front side of the bottom plate can be elevated using the arms 17. In the rear portion of the bottom plate 15 provided are stoppers 4 that regulate the elevation of the bottom plate 15, so that the rear portion of the bottom plate is urged by the spring 16 lest the bottom plate should be protruded from the sheet container section even when no sheets are contained.

To operate the pushing-up arms 17, the sheet feed cassette of the invention is designed so that a bar 14 is extended so as to be movably guided up and down by slots 13 provided on the side frame 3, while connecting the bar 14 and the pushing-up arms 17 by springs 18. Each pushing-up arm 17 is oscillatable through a pivot 17*b*, and a pushing portion 17*a* provided on the front end of each arm 17 corresponds to the front end portion of the bottom plate 15.

Figure 9:
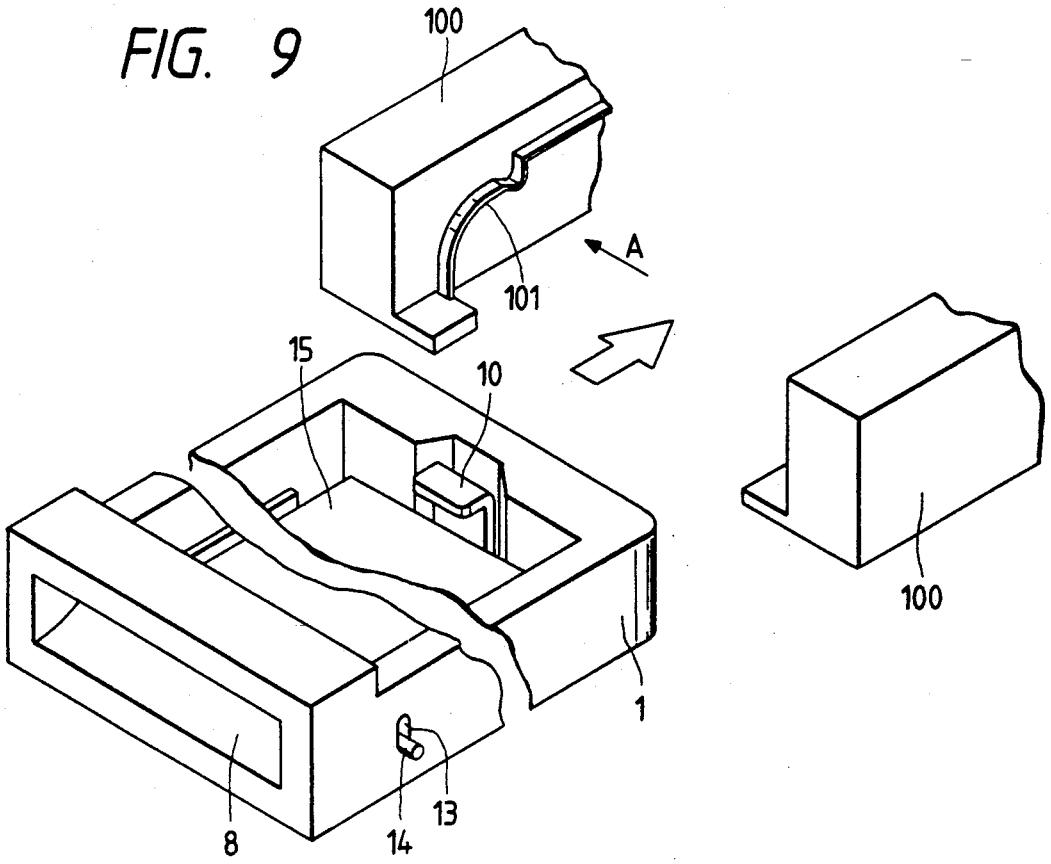
FIG. 9 is a diagram showing a construction of a sheet feed unit on an image forming apparatus body.
Figure 10:
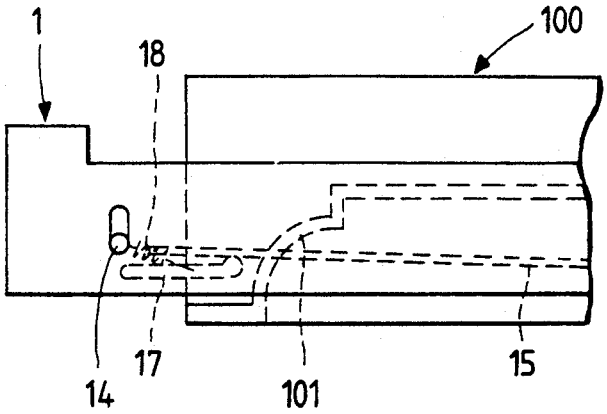
FIGS. 10 through 12 are diagrams showing an operation of pushing-up arms when the sheet feed cassette is installed to the sheet feed unit.
Figure 11:
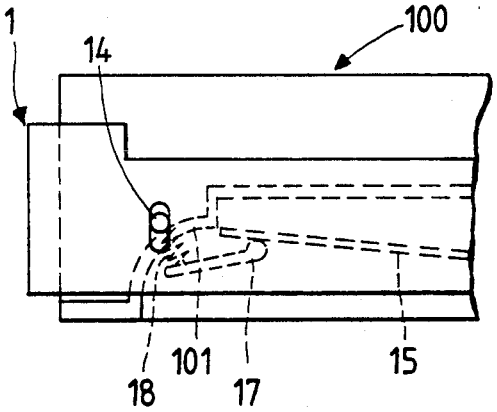
Figure 12:
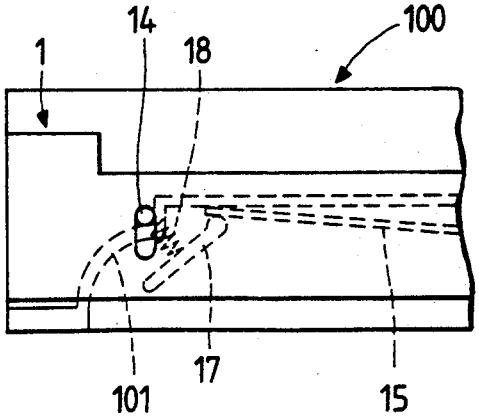

A construction of a sheet feed unit 100 on the image forming apparatus body side is shown in FIG. 9, and an operation of the arms 17 when the sheet feed cassette 1 is installed to the sheet feed unit 100 is shown in FIGS. 10, 11 and 12. FIGS. 10, 11 and 12 are diagrams showing the mechanism of the sheet feed unit 100 when viewed from an arrow A (FIG. 9).

FIG. 10 shows a state in which insertion of the sheet feed cassette 1 into the sheet feed unit 100 of the image forming apparatus is started. Under this condition the bar 14 of the sheet feed cassette is in a lower position. As the sheet feed cassette 1 is further pushed, the bar 14 ascends (FIG. 11) along a guide rail 101 of the sheet feed unit 100. The bar 14 under this condition is in a position slightly higher than the position shown in FIG.

10. When the sheet feed cassette 1 has been completely inserted (FIG. 12), the bar 14 is pushed up completely by the guide rail 101. At this point, the pushing-up arms 17 are urged by the springs 18 upward. Therefore, the sheet P can be brought into contact with the sheet feed rollers positioned at the front end of the sheet P which is the sheet feed side at a predetermined pressure while pushing up the bottom plate 15 through the pushing portions 17*n* front ends of the pushing-up arms 17.

Figure 3:
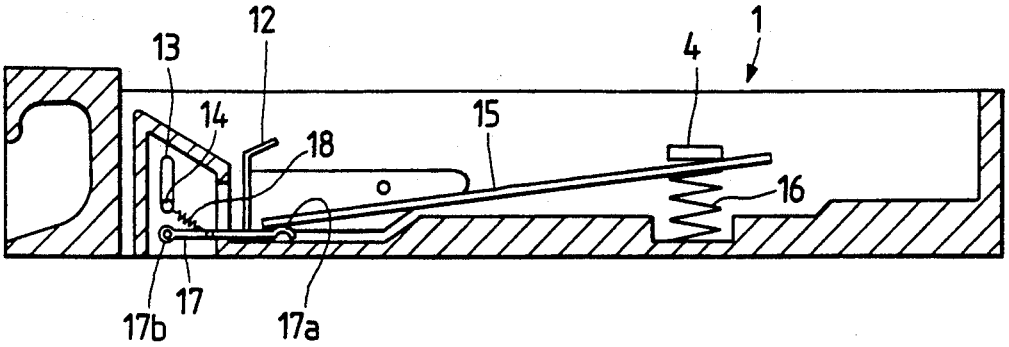
FIG. 3 is a diagram illustrative of a state in which no sheets are contained in the sheet feed cassette.

If no sheets are contained in the thus constructed sheet feed cassette of the invention, the rear portion of the bottom plate 15 is urged by the spring 16 and held by the stoppers 4 as shown in FIG. 3. The front side of the bottom plate 15 is in the lower position because the pushing-up arms 17 is not operating, and this condition causes the bottom plate to be inclined. Therefore, in placing sheets in the sheet feed cassette 1, the front ends of the sheets can be inserted between a snubber 12 and the plate 15 easily. When a large amount of sheets P are contained in the sheet feed cassette 1 and the cassette 1 is installed to the sheet feed unit, the spring 16 is contracted due to the weight of the sheets, so that the bottom plate 15 becomes substantially in parallel with the bottom frame 5, as shown in FIG. 4.

Figure 4:
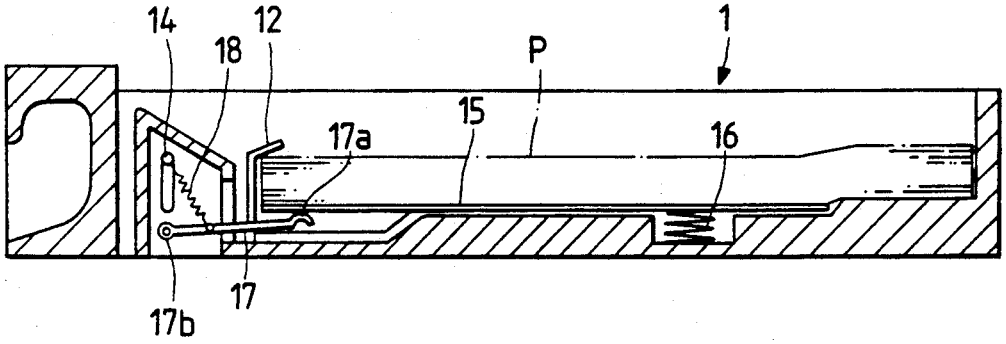
FIG. 4 is a diagram illustrative of a state in which many sheets are contained in the sheet feed cassette.

As the sheet feed cassette 1 supporting the sheets under the condition shown in FIG. 4 is installed to the sheet feed unit of the image forming apparatus, the bar 14 is elevated and the pushing-up arms 17 thereby push up the front end portion on the sheet feed side of the bottom plate 15. As a result, the sheet P is pushed up to a position corresponding to the sheet feed roller. When the front end portion of the bottom plate 15 is elevated, the rear portion of the plate 15 is also elevated while urged by the spring 16, causing the sheets to be elevated substantially horizontally to set the sheets to a sheet feed position.

Figure 5:
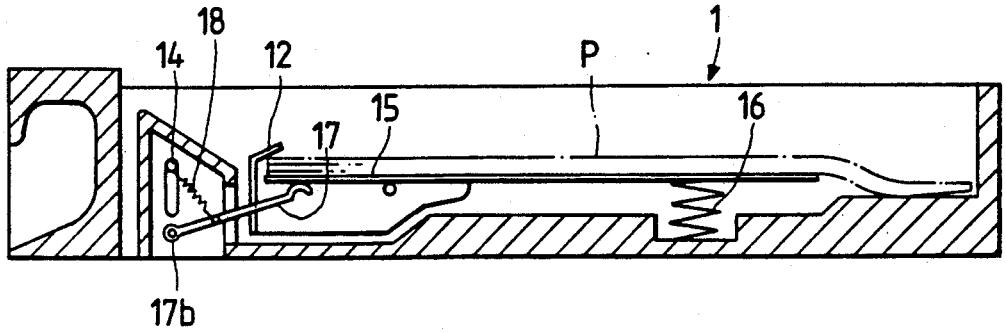
FIG. 5 is a diagram illustrative of a state in which the number of sheets is reduced in the sheet feed cassette.

When the sheet feed operation is continued under the condition shown in FIG. 4, the amount of sheets on the bottom plate 15 is gradually reduced to such an extent as shown in FIG. 5. However, even under such condition shown in FIG. 5, the bottom plate 15 keeps its substantially horizontal position, thereby allowing the front end of each sheet to abut against the sheet feed rollers at the same position. As a result, the sheet feed timing can be maintained consistent. Therefore, the sheet feed cassette of the invention obviates undesired inclination of the bottom plate even if the amount of sheets is changed and thereby permits the sheet feed operation with the sheets kept substantially in parallel.

Figure 6:
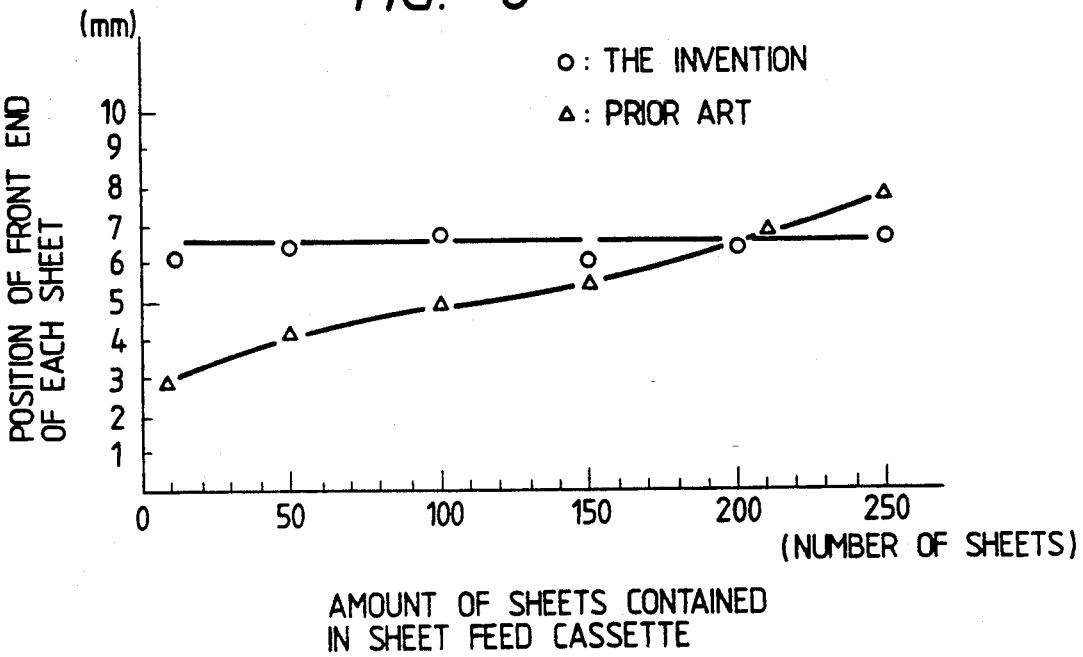
FIG. 6 is a graph showing variations in the position of the front end of a sheet when the sheet is being fed.

In the case of using the thus constructed sheet feed cassette of the invention, the sheet feed timing can be maintained consistent as shown in FIG. 6. For example, variations in the timing at which a sheet fed from the sheet feed cassette reaches the image transfer section (variations at the registration points) can be confined to so small a value that the front end of the sheet can reach the image transfer position at substantially the same timing. Therefore, when using the sheet feed cassette of the invention, instead of using a registration roller or gate unit along the sheet forward path as in the conventional image forming apparatus, the sheet fed from the sheet feed cassette is fed at a predetermined timing with respect to the toner image formed on the photoreceptor drum, so that the image can be transferred onto the sheet without causing the toner image to be out of position.

Figure 7:
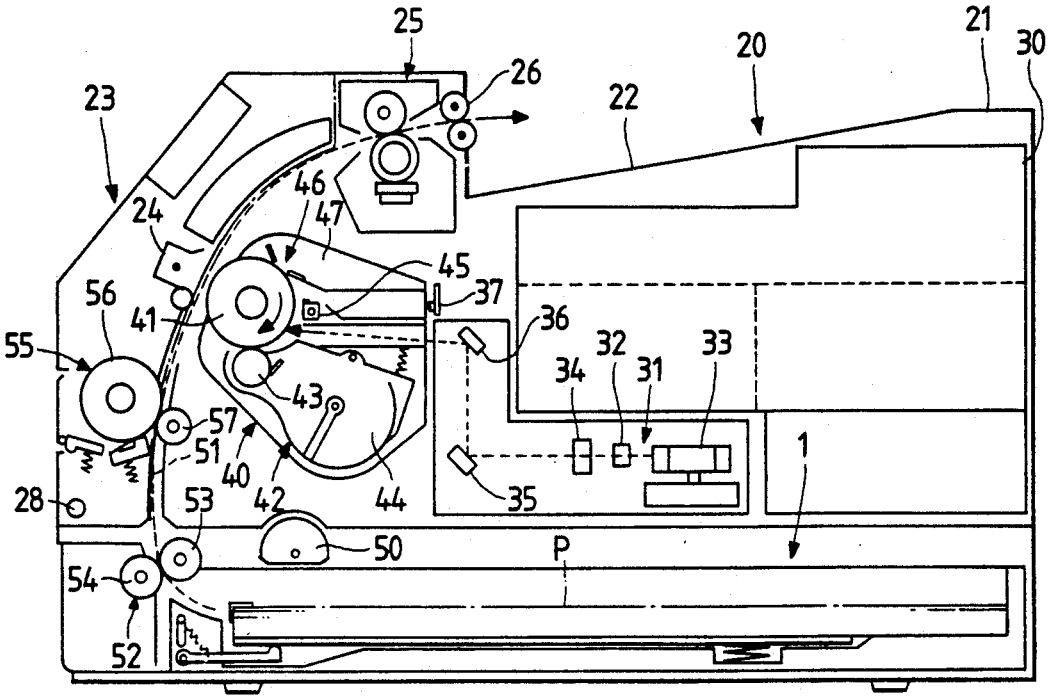
FIG. 7 is a diagram illustrative of a construction of a printer to which the sheet feed cassette of the invention can be applied.
Figure 8:
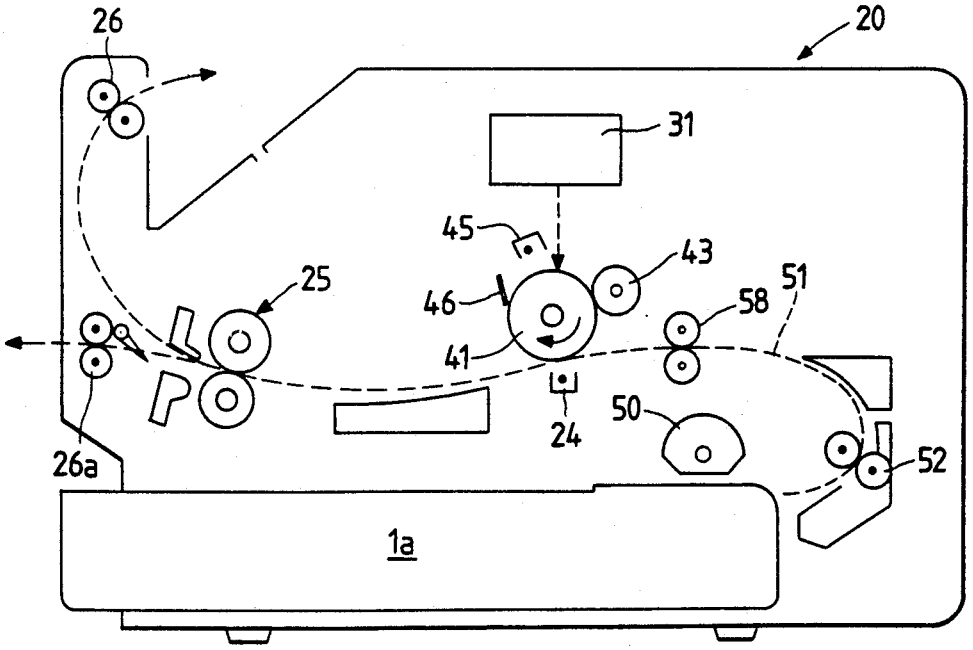
FIG. 8 PRIOR ART
FIG. 8 is a diagram illustrative of a printer using a conventional sheet feed cassette.

The thus constructed sheet feed cassette may be applied, e.g., to a printer shown in FIG. 7. The printer 20 shown in FIG. 7 is a very small printer, and a front frame 23 is arranged so as to be separable from a body frame 21 through a sheet forward path 51. On the body frame 21 is a discharge tray 22. In this printer 20 the body frame 21 includes a control section 30 and an image writing unit 31. Image data is written to a photoreceptor drum 41 by a laser beam applied from the writing unit 31. Like those used in ordinary laser printers, the image writing unit 31 reflects a laser beam applied from a laser oscillator 32 on a polygon mirror 33 and injects the laser beam onto the writing section of the photoreceptor drum 41 through an f$\theta$ lens 34 and a plurality of mirrors 35 and 36, to allow a latent electrostatic image to be formed on the photoreceptor drum 41.

The photoreceptor drum 41 is provided as part of an image forming unit 40. The unit 40 further includes a developing unit 42, a cleaning unit 46, and a charge corotron 45 in integrated form so as to be retractable from the body frame 21. The developing unit 42, among the components constituting the image forming unit 40, includes a toner cartridge 44 and a developing roller 43, and uses a means for feeding toner toward the developing roller 43 by a stirring member arranged inside the cartridge. Also, the cleaning unit 46 is designed as a member for cleaning the surface of the photoreceptor drum using a blade, and causes the toner scraped off by the blade to be contained in a recovered toner containing box 47. The charge corotron 45 is provided on the frame of the image forming unit 40 integrally therewith and is constructed to cause the frame to carry the tension of a corotron wire. With respect to the charge corotron 45, a section for projecting light beams from an eraser lamp 37 is provided on the upstream side of the photoreceptor drum in its rotating direction, so that the charges of the photoreceptor drum can be removed before charging the photoreceptor drum by the charge corotron.

In the printer 20 having the above-mentioned toner image forming means, along the sheet forward path 51 from the sheet feed cassette 1 the forward roller units 52 and 55 are arranged to forward a sheet. Further, in the front frame 23 for setting the sheet feed path 51, a transfer corotron 24 is provided at a position corresponding to the photoreceptor drum 41. Furthermore, downstream to the image transfer position, a fuser 25 and discharge rollers 26 are arranged, so that a copy fused by the fuser 25 is discharged toward a sheet discharge tray 22. In the printer 20 as the embodiment of the invention, the front frame 23 is arranged so as to be opened through a pivot 28, so that jamming occurring along the sheet forward path or replacement of the image forming unit can be taken care of with ease by opening the front frame 23.

In the sheet feeder of the above-mentioned printer, the sheet feed roller 50 disposed at the sheet feed section of the sheet feed cassette 1, which is a roller having a semicircular section in this embodiment, forwards the sheet fed from the sheet feed cassette 1 by the two forward roller units 52 and 55. The forward roller units 52 and 55 are made up of drive rollers 53 and 56, and pinch rollers 54 and 57, respectively. The roller 19 shown in FIG. 1 is the same member as the pinch roller 54 shown in FIG. 7.

To write an image onto the photoreceptor drum 41 in the above-mentioned printer 20, a single sheet P is fed into the sheet forward path 51 while applying a sheet feed command from the control section 30 and driving the sheet feed roller 50 in such a manner that the front end of the image reaches the photoreceptor drum at a timing. With the timing corresponding to the operation of forwarding such sheet along the sheet forward path at a predetermined speed and causing it to reach the image transfer section, the toner image formed on the photoreceptor drum is moved to the transfer section, and the toner image is thereby transferred to a predetermined position of the sheet. Therefore, the printer 20 does not need to employ a cumbersome control system in which the sheet is stopped on the way during the operation of forwarding the sheet and the sheet forwarding operation is resumed so as to correspond to the timing at which the toner image is formed on the photoreceptor drum. The printer 20 can thus perform the sheet feed and forward operation while maintaining the transfer position of the toner image accurately.

The sheet holding means of the invention in which the bottom plate is moved up and down while supported substantially horizontally is applied not only to the universal tray shown in the embodiment, but also to other type of sheet feed cassette or sheet feed tray for containing sheets of a predetermined size. Further, the sheet feed cassette of the invention can be applied to electronic copying machines other than printers as well. In such a case, a mechanism for feeding a sheet at a predetermined speed from the sheet feed cassette to the transfer section may be achieved with no registration unit.

Since the sheet feed cassette of the invention is constructed as described above, the construction of the member for supporting sheets within the sheet feed cassette can be simplified and the bottom plate can be elevated only when the sheet feed cassette is installed to the sheet feed unit. Further, to place additional sheets in the sheet feed cassette, the front end portion of the bottom plate is in the lowered position, thus facilitating the operation of inserting the sheets. Moreover, in the sheet feed cassette of the invention, the position of the front end of each sheet supported by the bottom plate can be maintained consistent irrespective of the amount of sheets contained therein, thereby preventing variations in the sheet feed timing of the front end of each sheet when the sheets are being fed. In addition, the image forming apparatus using the sheet feed cassette of the invention is not required to provide any means for positioning the front end of the sheet, thereby allowing the apparatus to be constructed so that an image is transferred while forwarding a sheet fed from the sheet feed cassette at a predetermined speed.

What is claimed is:

1. A sheet feed cassette to be installed to a sheet feed unit of an image forming apparatus, comprising:

frame means including at least a side frame and a bottom frame;

a bottom plate, provided above the bottom frame of said frame means, for placing and supporting sheets thereon, said bottom plate being capable of moving up and down;

pushing-up means, provided at a front end portion of a sheet feed side of said bottom plate, for pushing up said bottom plate with respect to the bottom frame of said frame means when said sheet feed cassette is installed to the sheet feed unit of the image forming apparatus, the pushing-up means including a pushing-up arm, means for moving said pushing-up arm against the bottom plate, and a guide rail on the sheet feed unit of the image forming apparatus for causing the moving means to urge the pushing-up arm against the bottom plate; and first spring means, provided at an end portion opposite to the sheet feed side of said bottom plate, for urging up said bottom plate with respect to the bottom frame of said frame means.

2. The sheet feed cassette according to claim 1, further comprising a stopper member for regulating an elevation of said bottom plate.

3. The sheet feed cassette according to claim 1, further comprising a roller member acting as a pinch roller of a forward roller unit in the image forming apparatus.

4. A sheet feed cassette to be installed to a sheet feed unit of an image forming apparatus, comprising:

frame means including at least a side frame and a bottom frame;

a bottom plate, provided above the bottom frame of said frame means, for placing and supporting sheets thereon, said bottom plate being capable of moving up and down;

pushing-up means, provided at a front end portion of a sheet feed side of said bottom plate, for pushing up said bottom plate with respect to the bottom frame of said frame means when said sheet feed cassette is installed to the sheet feed unit of the image forming apparatus, wherein said pushing-up means includes a pushing-up warm, a bar extended to protrude from a slot provided on the side frame of said frame means and capable of moving up and down along a guide rail provided on the sheet feed unit of the image forming apparatus, and second spring means for connecting said pushing-up arm and said bar; and first spring means, provided at an end portion opposite to the sheet feed side of said bottom plate, for urging up said bottom plate with respect to the bottom frame of said frame means.

5. The sheet feed cassette according to claim 4, wherein said pushing-up arm includes a pivot portion through which said pushing-up arm is oscillatable, and a pushing portion for pushing a lower surface of said bottom plate.

6. A sheet feed cassette to be installed in a sheet feed unit of an image forming apparatus, comprising:

a frame having a bottom wall, a plurality of side walls, and a front sheet feed portion;

a plate supported on the bottom wall of the frame, the plate having a front end adjacent the front sheet feed portion of the frame and a rear end opposite the front portion of the frame;

first means, between the bottom wall of the frame and the rear end of the plate, for urging the rear end of the plate upwardly relative to the bottom wall of the frame; and second means for urging the front end of the plate upwardly relative to the bottom wall of the frame in response to positioning the sheet feed cassette into the sheet feed unit of the image forming apparatus.

7. The sheet feed cassette of claim 6, wherein the rear end of the plate is inclined relative to the front end of the plate when the sheet feed cassette is not positioned in the sheet feed unit of the image forming apparatus.

* * * * *

UNITED STATES PATENT AND TRADEMARK OFFICE

CERTIFICATE OF CORRECTION

PATENT NO. : 5,232,215

DATED : August 03, 1993

INVENTOR(S) : Yusaku HASHIMOTO et al.

It is certified that error appears in the above-indentified patent and that said Letters Patent is hereby corrected as shown below:

Claim 4, column 8, line 29, change "warm" to --arm--.

Signed and Sealed this

Twenty-first Day of June, 1994

*Attest:*

Bruce Lehman

BRUCE LEHMAN

*Attesting Officer*

*Commissioner of Patents and Trademarks*